US006919805B2

(12) United States Patent
Song et al.

(10) Patent No.: US 6,919,805 B2
(45) Date of Patent: Jul. 19, 2005

(54) WALLET WITH ALARM DEVICE INSTALLED THEREIN

(76) Inventors: Bae Ho Song, Koongiun Villa 202, Hwakok-Bondong, Kangseo-ku, Seoul (KR), 46-68; Chul Soo Kim, Woosung Apt. 103-1608, 1706 Bongchun-dong, Kwanak-ku, Seoul (KR), 32/12

( * ) Notice: Subject to any disclaimer, the term of this patent is extended or adjusted under 35 U.S.C. 154(b) by 39 days.

(21) Appl. No.: 10/437,415

(22) Filed: May 13, 2003

(65) Prior Publication Data

US 2004/0227633 A1 Nov. 18, 2004

(51) Int. Cl.[7] ..... G08B 13/14

(52) U.S. Cl. ..... 340/568.7; 340/571; 340/572.8; 150/133; 150/134

(58) Field of Search ..... 340/568.7, 571, 340/572.8; 150/133, 134

(56) References Cited

U.S. PATENT DOCUMENTS 3,930,249 A * 12/1975 Steck et al. ..... 340/571
4,242,670 A * 12/1980 Smith ..... 340/555
4,558,307 A * 12/1985 Lienart van Lidt de Jeude 340/527
4,825,922 A * 5/1989 Rolfs ..... 150/134
4,884,062 A * 11/1989 Lin et al. ..... 340/568.7
5,053,750 A * 10/1991 Alex ..... 340/568.7
5,379,024 A * 1/1995 Hsu ..... 340/568.7
5,412,373 A * 5/1995 Wajda ..... 340/571
5,790,027 A * 8/1998 Chern ..... 340/568.7
2004/0159688 A1 * 8/2004 Udolph ..... 224/191

* cited by examiner

*Primary Examiner*—Jeffery Hofsass
*Assistant Examiner*—Eric Blount
(74) *Attorney, Agent, or Firm*—IP Strategies

(57) ABSTRACT

A wallet is disclosed in which a theft prevention device is installed. If the wallet departs from the pocket, a melody is generated so that the owner can recognize the departure of the wallet from the pocket, thereby preventing the theft of the wallet. An oscillation plate is installed between the outer cover and the inner layer of the wallet, and a photo sensor is installed to respond to the visible light so as to activate the oscillation plate. Further a manual switch is installed to make it possible to turn the power source on or off.

4 Claims, 3 Drawing Sheets

WALLET WITH ALARM DEVICE INSTALLED THEREIN

FIELD OF THE INVENTION

The present invention relates to a theft prevention wallet, and more specifically to a theft prevention wallet in which there is installed a device for generating an alarm sound when exposed to the visible light, and if the wallet is taken out of the dark pocket interior and exposed to the visible light, then an alarm sound is generated, thereby preventing the wallet from being stolen.

BACKGROUND OF THE INVENTION

Generally, a wallet contains paper moneys, identification cards, credit cards and the like, and therefore, it is a precious article.

Accordingly, the wallet is kept in a deep pocket, but it is liable to be stolen to a pickpocket in the crowded trains, buses or streets. However, if the wallet departs from the pocket by an action of a pickpocket, it cannot be easily recovered.

SUMMARY OF THE INVENTION

The present invention is intended to overcome the above-described disadvantages of the conventional practice.

Therefore it is an object of the present invention to provide a theft prevention wallet in which there is installed a device for generating an alarm sound when exposed to the visible light, and if the wallet is taken out of the dark pocket interior and exposed to the visible light, then an alarm sound is generated, thereby preventing the wallet from being stolen.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

The preferred embodiment of the present invention will be described in detail referring to the attached drawings.

Figure 1:
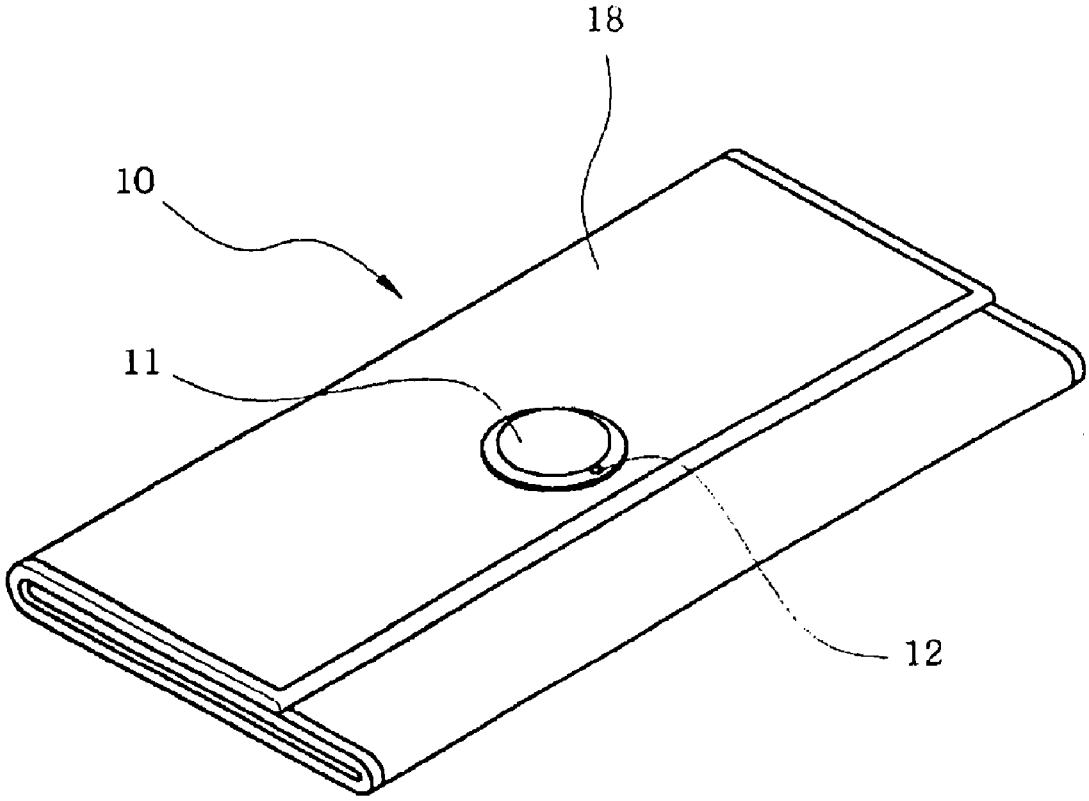
FIG. 1 is a perspective view of the device according to the present invention.
Figure 2:
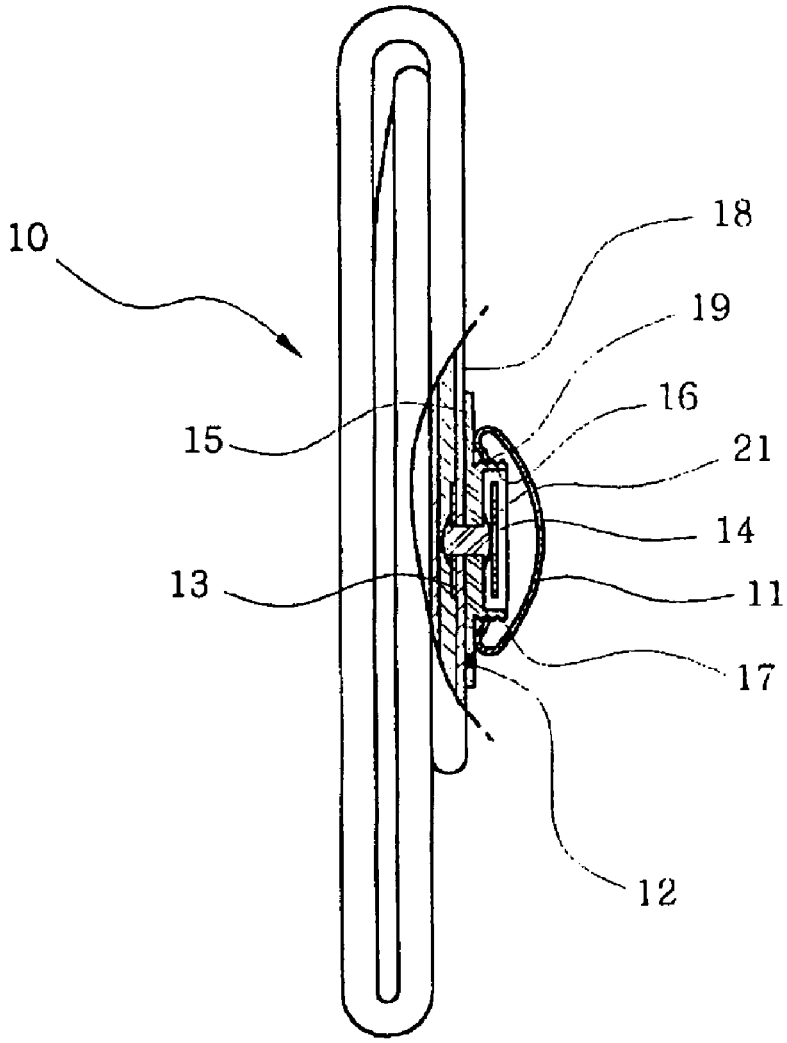
FIG. 2 is a sectional view of the device according to the present invention.
Figure 3:
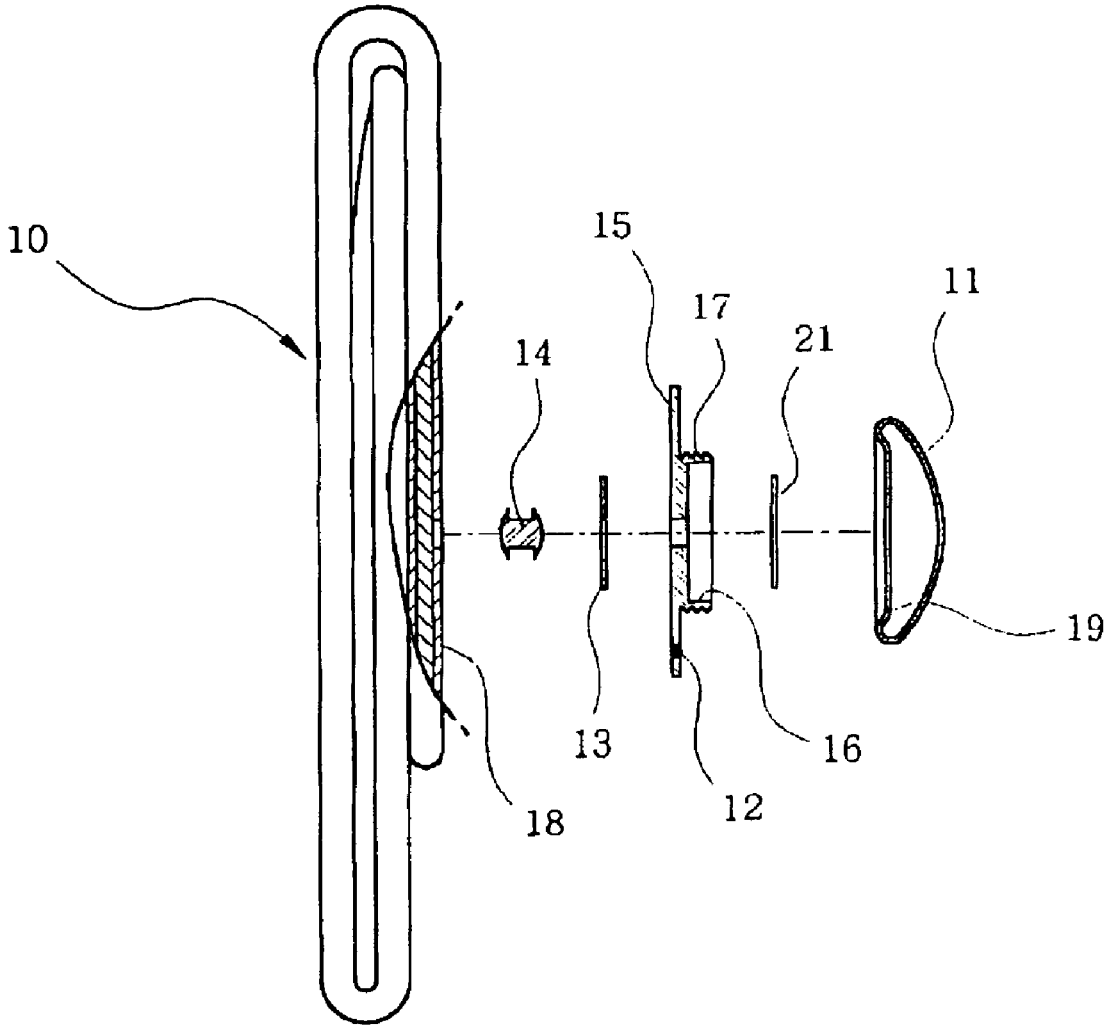
FIG. 3 is an exploded view of the device according to the present invention.

FIG. 1 is a perspective view of the device according to the present invention. FIG. 2 is a sectional view of the device according to the present invention. FIG. 3 is an exploded view of the device according to the present invention.

If a wallet is always exposed to the visible light, then it is not applicable to the present invention, because the wallet 10 of the present invention generates an alarm by means of a photo sensor 12.

The wallet stores an inherent melody so that the melody can be quickly recognized by the owner of the wallet when the alarm is generated.

As shown in FIG. 2, the alarm-generating device of the present invention is installed on an outer cover 18 of the wallet 10.

A supporting plate 13 is installed on the inside of the outer cover 18 of the wallet 10 at a selected position thereof. A supporting rod 14 is secured on the supporting plate 13 in such a manner that the supporting rod 14 passes through the outer cover 18 to reach the outside of the outer cover 18. Further, the supporting rod 14 is fitted to a securing plate 15 which is secured to the outside of the outer cover 18. As shown in FIG. 3, the securing plate 15 may be round or rectangular.

In the preferred embodiment of the present invention, the securing plate 15 is round.

A cylindrical projection 16 projects integrally from the securing plate 15.

Threads 17 are formed around the outer circumference of the cylindrical projection 16.

A arcuate resonance tube 11 is coupled to the securing plate 15.

The edge of the resonance tube 11 is turned inward to form an annular step so as to be coupled to the threads 17 of the cylindrical projection 16.

The outside circumference of the resonance tube 11 responds to the visible light, and the power is turned on or off if the user turns the resonance tube 11, thereby making it possible to stop the continuation of the generation of the alarm.

Now the present invention will be described based on an example.

The wallet 10 is kept within the pocket almost all day long, and therefore, the wallet 10 is shielded from the visible light. However, the wallet 10 is exposed if the user takes the wallet out of the pocket to use it, or if a pickpocket takes the wallet 10 out of the owner's pocket.

In the case where the owner takes out the wallet and an alarm is generated, the owner suppresses the alarm by touching the switch.

On the outer circumference of the resonance tube 11, there can be decorated with gems or other accessories.

As shown in FIG. 2, on the inside of the outer cover 18 of the wallet 10, there is disposed the supporting plate 13, while on the outside of the outer cover 18, there is disposed the securing plate 15. Further, the supporting rod 14 is disposed between the supporting plate 13 and the securing plate 15, to support the two plates 13 and 15, thereby making the two plates 13 and 15 closely contacted to the outer cover 18.

The cylindrical projection 16 integrally stands up from the securing plate 15 toward outside, and has the threads 17. A power source is disposed within the securing plate 15, and if the power source is connected, then the alarm is generated.

The resonance tube 11 is coupled to the threads 17 of the securing plate 15.

The threads 17 and the resonance tube 11 are coupled together in such a manner that an inwardly coiled step 19 of the edge of the resonance tube 11 is coupled to the threads 17 by threadably turning the resonance tube 11. Under this condition, a contact (not illustrated) of the threads and a contact (not illustrated) of the coiled step 19 are electrically connected together. Thus, if the turning of the resonance tube 11 is completed, then the power source is in the connected status.

That is, the power source is installed in the securing plate 15, the outer circumference of the resonance tube 11 is made photosensitive, and the resonance tube 11 is coupled to the threads of the securing plate 15. Thus, if the resonance tube

11 is exposed to the visible light, then the power source is electrically connected to the photo sensor 12, thereby generating an alarm.

The pickpockets perform their stealing actions at crowded places, and therefore, the sound of the alarm should be loud as far as possible if it is to be effective.

Therefore, a resonance plate 21 is placed within the resonance tube 11 so that the alarm sound would be subjected to a resonance. Thus the alarm sound makes the resonance plate oscillated, thereby making the alarm sound louder.

If the owner takes out the wallet, and thus if the alarm is generated, then the owner can turn the resonance tube 11 in a direction opposite to the case of the coupling of it, so that the electric connection of the power source would be disconnected, thereby suppressing the alarm.

When the owner finishes the use of the wallet 10, the resonance tube 11 should be electrically connected by turning it. Thus if the wallet 10 is put back into the pocket, then the alarm is kept suppressed, because the visible light is shielded within the pocket.

According to the present invention as described above, as soon as the wallet departs from the pocket, the alarm is generated, and the melody is special. Accordingly, the departure of the wallet from the pocket can be easily recognized by the owner.

Therefore, if the wallet departs from the pockets by a pickpocket or during an athletic activity, then the owner can easily recover the wallet.

What is claimed is:

1. A wallet with an alarming device installed therein, comprising:

a supporting plate secured on an inside of an outer cover of the wallet;

a securing plate attached to an outside of the outer cover of the wallet;

a supporting rod connecting the supporting plate and the securing plate together; and an arcuate resonance tube with a photo sensor disposed at its outside circumference, an edge of the resonance tube being turned inward to form an annular step so as to be coupled to the securing plate.

2. The wallet as claimed in claim 1, wherein a cylindrical projection stands up integrally from the securing plate, threads being formed around the cylindrical projection, and an electric contact being formed on the threads.

3. The wallet as claimed in claim 1, wherein a power source, a signal generating device and a resonance plate are disposed within the securing plate, and signals are generated when the photo sensor responds to visible light.

4. The wallet as claimed in claim 1, wherein a contact is formed on the annular step of the resonance tube, and the resonance tube has an arcuate shape to make the alarm sound louder.

* * * * *